US007251443B2

(12) United States Patent
Koike et al.

(10) Patent No.: US 7,251,443 B2
(45) Date of Patent: Jul. 31, 2007

(54) LASER PRINTER WITH DISELECTRIFICATION BRUSH

(75) Inventors: Kazushi Koike, Daito (JP); Kiyoshi Chinzei, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 110 days.

(21) Appl. No.: 11/146,177

(22) Filed: Jun. 6, 2005

(65) Prior Publication Data

US 2005/0276637 A1 Dec. 15, 2005

(30) Foreign Application Priority Data

Jun. 11, 2004 (JP) ..... 2004-174177

(51) Int. Cl.
*G03G 15/14* (2006.01)

(52) U.S. Cl. ..... 399/297; 399/310; 399/315

(58) Field of Classification Search ..... 399/315, 399/117, 390, 384
See application file for complete search history.

(56) References Cited

U.S. PATENT DOCUMENTS 5,345,295 A * 9/1994 Takano et al. ..... 399/125
5,758,247 A * 5/1998 Yanashima et al. ..... 399/384

FOREIGN PATENT DOCUMENTS

| | | |
|---|---|---|
| JP | 5-107935 | 4/1993 |
| JP | 9-114277 | 5/1997 |
| JP | 2001-154495 | 6/2001 |

OTHER PUBLICATIONS

Patent Abstracts of Japan, Publication No. 2001-154495 dated Jun. 8, 2001, 1 page.
Patent Abstracts of Japan, Publication No. 09-114277 dated May 2, 1997, 1 page.
Patent Abstracts of Japan, Publication No. 05-107935 dated Apr. 30, 1993, 1 page.

* cited by examiner

*Primary Examiner*—David M. Gray
*Assistant Examiner*—David A Blackshire
(74) *Attorney, Agent, or Firm*—Osha Liang LLP

(57) ABSTRACT

A laser printer includes a photoreceptor drum, a transfer roller contacting the photoreceptor drum, a transfer roller frame holding the transfer roller, an outer frame holding the transfer roller frame, a diselectrification brush fixed to the transfer roller frame, and a spring at least having a surface formed of conductive material for biasing the transfer roller toward the photoreceptor drum. The spring is formed of a single member and has a first extension contacting the diselectrification brush and a second extension contacting the outer frame.

13 Claims, 6 Drawing Sheets

LASER PRINTER WITH DISELECTRIFICATION BRUSH

BACKGROUND OF THE INVENTION

1. Field of the Invention

The present invention relates laser printers and particularly to configurations for grounding the laser printer's diselectrification brush.

2. Description of the Background Art

A laser printer arranges toner on a surface of a photoreceptor drum charged by laser light and sandwiches a sheet between the photoreceptor drum and a transfer roller to place the toner on a surface of the sheet or the like in a shape to be transferred. The toner placed on the surface of the sheet or the like is fixed on the sheet or the like by a fixture roller and thus discharged.

The sheet or the like having passed between the photoreceptor drum and the transfer roller is statically charged. To remove the static electricity, a diselectrification brush diselectrifying the sheet or the like is arranged adjacent for example to the sheet or the like output through between the transfer roller and the photoreceptor drum.

For example Japanese Patent Laying-Open No. 9-114277 discloses a transfer apparatus having a diselectrification needle arranged in a prescribed diselectrification region to achieve the needle's significant diselectrification effect. As disclosed in the document, if in this transfer apparatus the apparatus's cover attached disadvantageously clatters, a spring contact's resilience can compensate for the clatter to allow the needle and a transfer nip to have a fixed relative positional relationship therebetween.

Furthermore FIG. 7 shows a cross section of an image formation apparatus disclosed in Japanese Patent Laying-Open No. 2001-154495. A sheet or the like is transported along a transport path 72 in a direction 61. The sheet or the like is sandwiched between a transfer roller 51 and a rotation roller 52 and thus transported. Around transfer roller 51 is arranged a transport guide 57 with a control member 54 joined thereto.

A diselectrification brush 53 is joined to control member 54, and control member 54 is connected to a plate 60 via an extension contact 55 and a ground plate 56. By grounding plate 60, diselectrification brush 53 provides diselectrification. The member contacting and thus controlling the brush's bristles is adapted to be conductive to allow the bristles to be grounded to ensure that the bristles are grounded and a material receiving what is transferred is diselectrified, as described in the document.

A diselectrification brush is used to diselectrify sheets or the like. If the sheet or the like is not diselectrified, the sheet or the like is disadvantageously attracted to the photoreceptor drum. More specifically, the sheet or the like does not readily come off the photoreceptor drum and is not transported smoothly. Furthermore, if the charged sheet or the like is continuously transported, the sheet being transported is disadvantageously attracted by other components. In other words, the performance of transporting the sheet is impaired. Accordingly, diselectrification of the sheet or the like must be ensured at a transport path immediately following the photoreceptor drum.

Japanese Patent Laying-Open Nos. 9-114277 and 2001-154495 disclose apparatuses provided with a diselectrification brush for diselectrification. However, they disadvantageously have a complicated mechanism to ground the diselectrification brush. Furthermore, they have a large number of components resulting in poor productivity.

SUMMARY OF THE INVENTION

The present invention has been made to overcome the above disadvantages and it contemplates a laser printer having a symbol configuration and formed of a reduced number of components.

To achieve the above object the present invention in one aspect provides a laser printer including: a columnar photoreceptor drum; a transfer roller formed in a column and arranged to linearly contact the photoreceptor drum; a transfer roller frame covering the transfer roller and holding a rotation shaft of the transfer roller; a metallic outer frame having the transfer roller frame pivotably fixed thereto; a metallic spring formed to bias the transfer roller frame toward the photoreceptor drum; and a diselectrification brush arranged on an external surface of the transfer roller frame. The spring is formed of a single elongate member, and includes a helical portion, and a first extension extending from the helical portion toward the diselectrification brush to contact the diselectrification brush, a second extension extending from the helical portion toward the outer frame to contact the outer frame. The first extension has a portion bent to be flat, as seen in a plane, along a surface of the diselectrification brush and is formed to be biased toward a surface of the diselectrification brush. The second extension has a portion bent to be flat, as seen in a plane, along a surface of the outer frame and is formed to be biased toward a surface of the outer frame. A laser printer having a simplified configuration and formed of a reduced number of components can thus be provided.

To achieve the above object the present invention in another aspect provides a laser printer including: an outer frame; a photoreceptor drum; a transfer roller contacting the photoreceptor drum; a transfer roller frame holding the transfer roller; a diselectrification brush fixed to the transfer roller frame; and a resilient member at least having a surface formed of conductive material for biasing the transfer roller toward the photoreceptor drum. The resilient member is formed of a single member, and has one end contacting the diselectrification brush and the other end contacting the outer frame. A laser printer having a simplified configuration and formed of a reduced number of components can thus be provided.

In the present invention preferably the resilient member is formed of a single elongate member of metal, and includes a helical portion, and a first extension extending toward the diselectrification brush to contact the diselectrification brush, a second extension extending toward the outer frame to contact the outer frame. This can facilitate forming the resilient member.

In the present invention preferably the first extension is linearly formed and adapted to be biased toward a surface of the diselectrification brush. This ensures that the first extension is brought into contact with the diselectrification brush.

In the present invention preferably the second extension is linearly formed and adapted to be biased toward a surface of the outer frame. This ensures that the second extension is brought into contact with the outer frame.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

With reference to FIGS. 1-6 the present invention in an embodiment provides a laser printer as will be described hereinafter.

Figure 1:
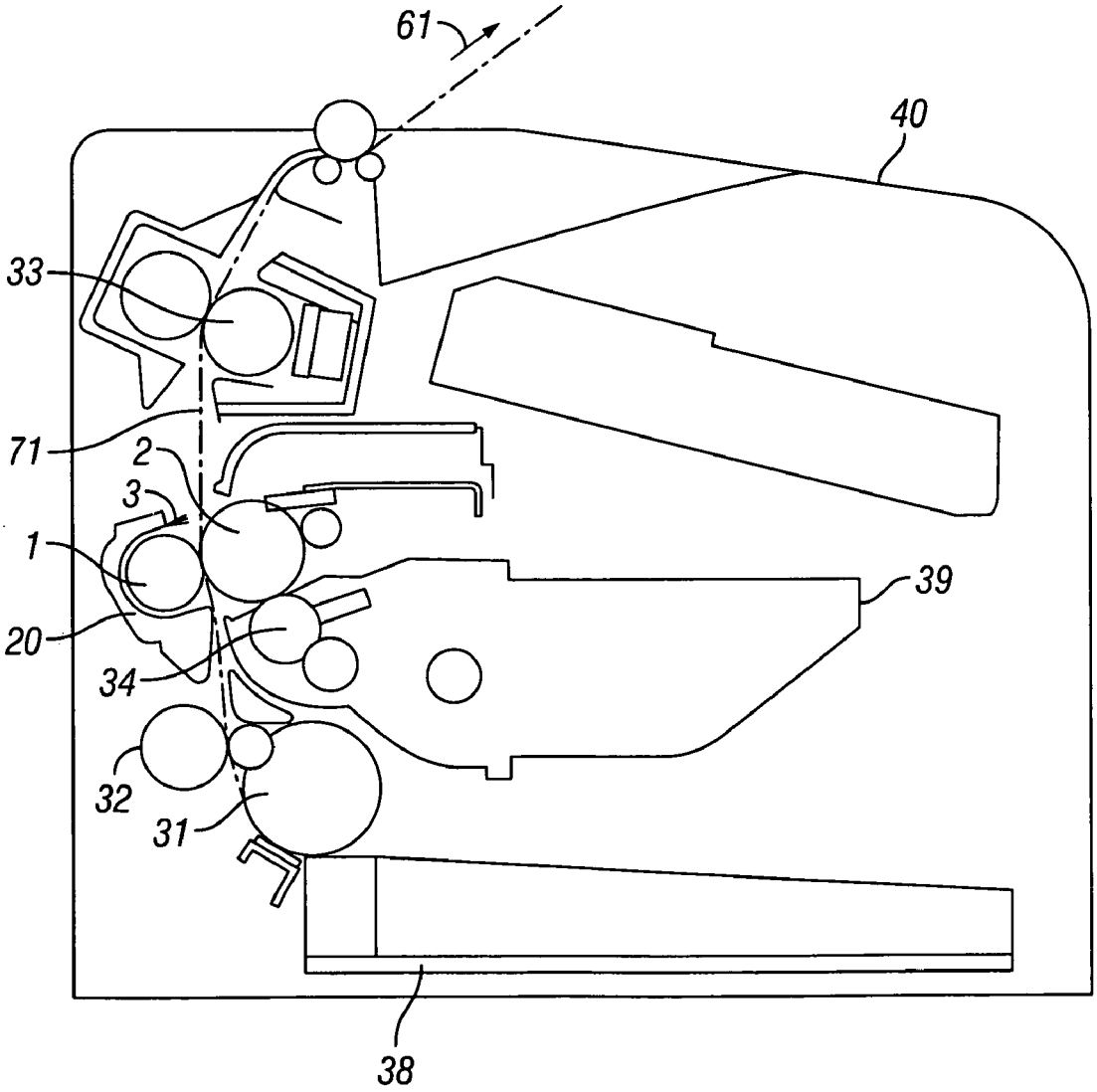
FIG. 1 is a schematic cross section of a laser printer in an embodiment.

FIG. 1 is a schematic cross section of the laser printer in the present embodiment. The laser printer has each component arranged in a casing 40. At a lower portion of casing 40 a sheet tray 38 is arranged to accommodate sheets or the like to be printed. (In the present invention, papers, cellophane sheets or the like to be printed will generally be referred to as sheets.) At an upper end of sheet tray 38 is arranged a pick roller 31 to extract a sheet from sheet tray 38. The sheet is transported along a transport path 71 in a direction 61.

Along transport path 71 are arranged a transport roller 32 transporting the sheet, and a photoreceptor drum 2 and a transfer roller 1 for placing toner in a desired form on a surface of the sheet. Also arranged along transport path 71 is a fixture roller 33 fixing the toner on the surface of the sheet.

Along transport path 71 a diselectrification brush 3 is positioned adjacent to a location passing the sheet having just contacted photoreceptor drum 2. In the present embodiment diselectrification brush 3 has bristles spaced from transport path 71, as predetermined.

Casing 40 accommodates a toner cartridge 39 substantially at a center thereof. Toner cartridge 39 has toner therein. Toner cartridge 39 is exchangeably formed so that when toner runs out, toner cartridge 39 can be exchanged. In FIG. 1 the right hand of the sheet of the figure corresponds to a front side of the printer and the sheet or the like to be printed is output toward the front side.

In the present embodiment photoreceptor drum 2 is arranged in casing 40 closer to a rear side. Photoreceptor drum 2 and transfer roller 1 are arranged to sandwich the sheet or the like to be printed. Photoreceptor drum 1 is arranged in contact with a developer roll 34.

Transfer roller 1 is surrounded by a transfer roller frame 20. In the present embodiment, transfer roller 1, photoreceptor drum 2, developer roll 34 and other similar various types of rollers are each formed in a column.

Figure 2:
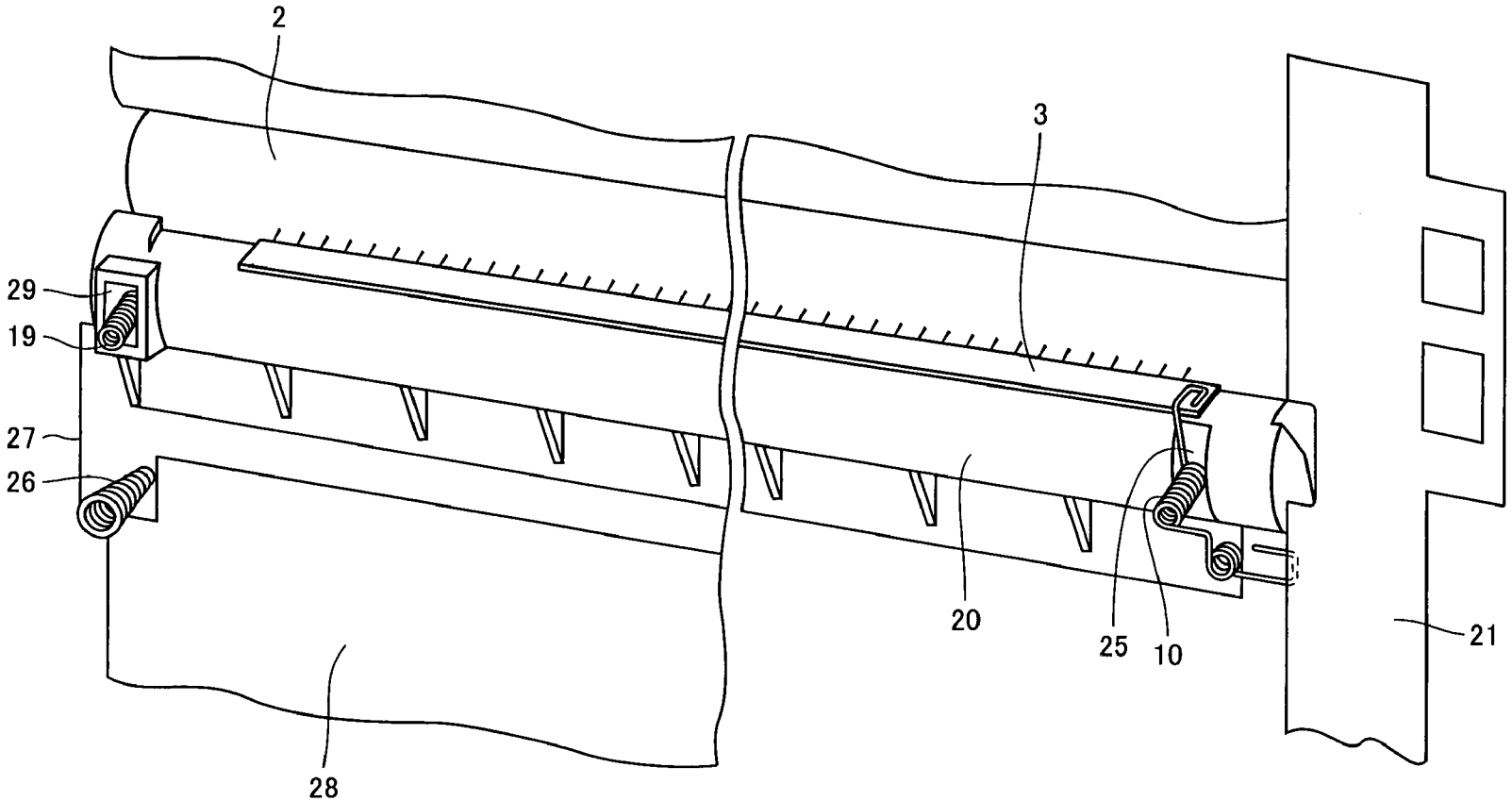
FIG. 2 is a perspective view of a back side of a transfer roller frame of the laser printer in the embodiment.

FIG. 2 is a perspective view of transfer roller frame 20 as seen at a back side. Transfer roller frame 20 is formed to match a columnar geometry corresponding to an external geometry of the transfer roller. Transfer roller frame 20 has an upper surface with diselectrification brush 3 arranged thereon. Diselectrification brush 3 is formed along an end of the upper surface of transfer roller frame 20 to have a longitudinal direction. At a side of transfer roller frame 20 an outer frame 21 formed of metal is arranged.

Transfer roller frame 20 is formed to have the longitudinal direction substantially parallel to the transfer roller's axial direction. Transfer roller frame 20 is provided with recesses 25 and 29 at a back surface at opposite ends as seen in the longitudinal direction.

Recess 25 is formed in a trench penetrating transfer roller frame 20 in a direction perpendicular to the longitudinal direction. Recess 29 is a recessed portion provided at the back surface of transfer roller frame 20.

In the present embodiment the transfer roller is biased toward the photoreceptor drum by resilient means implemented by springs 10, 19. In the present embodiment springs 10, 19 are both formed of metal. Spring 10 is partially arranged in recess 25, and spring 19 is partially arranged in recess 29. Springs 10 and 19 are formed to bias transfer roller frame 20 toward photoreceptor drum 2. Below transfer roller frame 20 is provided a high voltage producing plate 28 and a conical spring 26 and a connection line 27 electrically connect plate 28 and spring 19.

Figure 3:
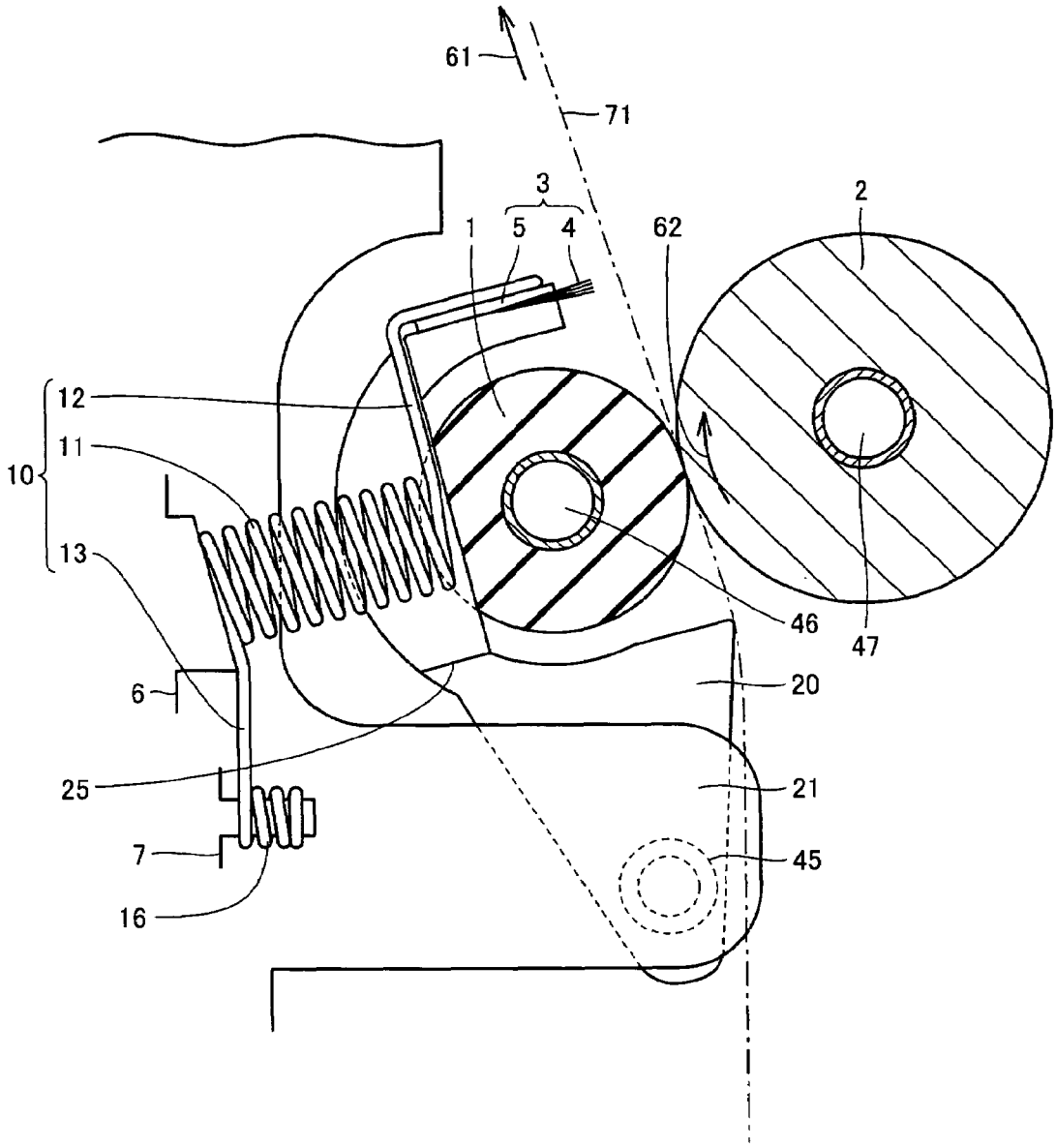
FIG. 3 is an enlarged cross section of a portion corresponding to a transfer roller and a spring in the embodiment.

FIG. 3 is an enlarged cross section of a portion corresponding to the transfer roller and the resilient means or the spring. Photoreceptor drum 2 is formed in a column to rotate, as indicated by an arrow 62, around a rotation shaft 47. Transfer roller 1 rotates around a rotation shaft 46 in accordance with the rotation of photoreceptor drum 2 indicated by arrow 62. Transfer roller 1 is formed in a column and arranged to linearly contact photoreceptor drum 2. The transfer roller 1 rotation shaft 46 is held by transfer roller frame 20.

Transfer roller frame 20 has a support shaft 45 connected to outer frame 21. Transfer roller frame 20 is adapted to pivot around support shaft 45 serving as a spindle. Transfer roller 1 pivots together with transfer roller frame 20 integrally.

Of an outer surface of transfer roller frame 20, an end of that side facing photoreceptor drum 2 is provided with diselectrification brush 3. In the present embodiment, diselectrification brush 3 includes bristles 4 providing diselectrification and a conductive tape 5 electrically connecting bristles 4. In the present embodiment, bristles 4 is sandwiched and thus fixed between transfer roller frame 20 and conductive tape 5. Conductive tape 5 is formed in a plane and has a surface provided with a flat portion.

Figure 4:
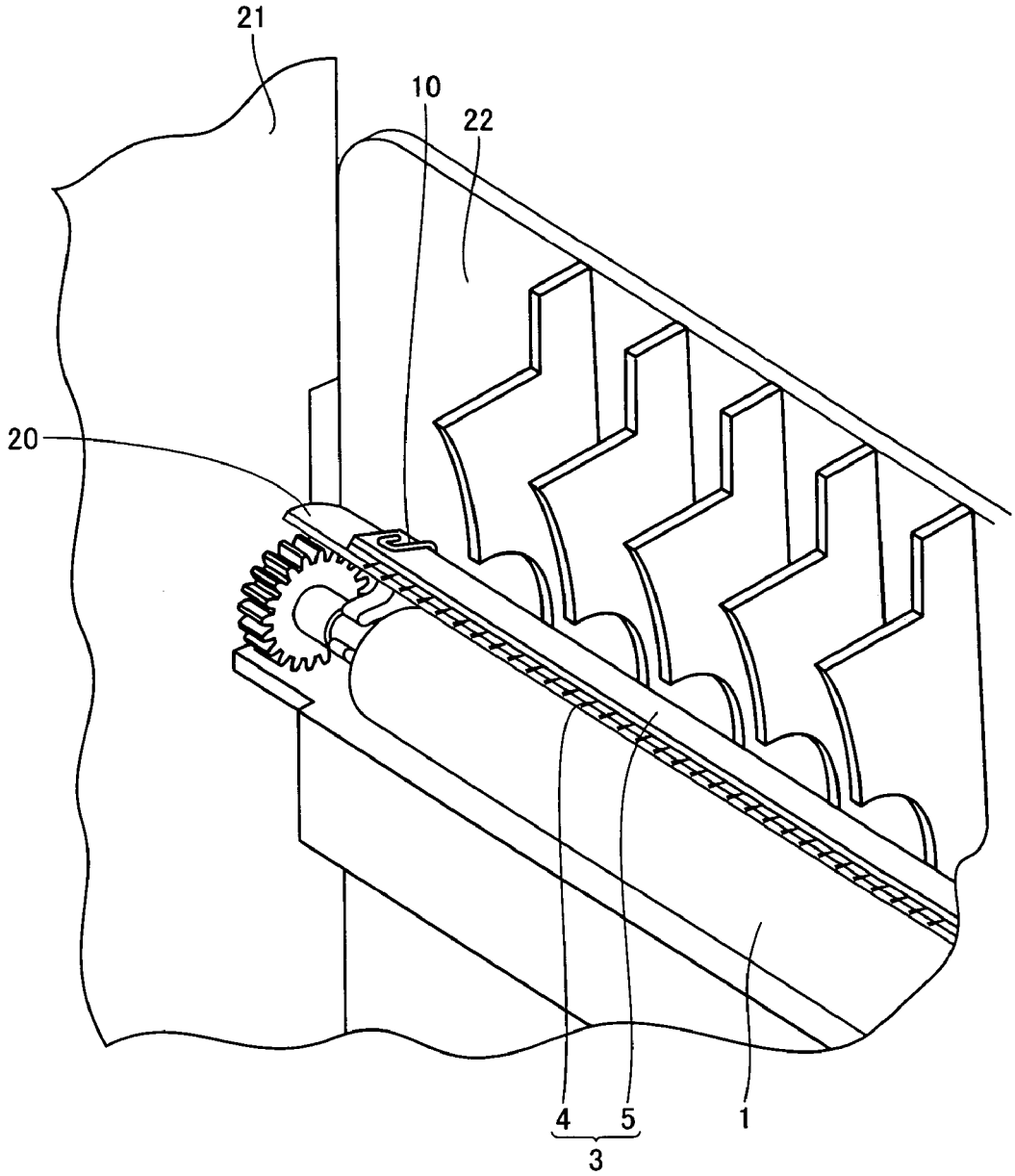
FIG. 4 is an enlarged perspective view of the transfer roller and the transfer roller frame in the embodiment.

FIG. 4 is a perspective view of transfer roller 1 and transfer roller frame 20 as seen at a side at which the photoreceptor drum is arranged. Behind transfer roller frame 20 an outer frame 22 of resin is formed. Diselectrification brush 3 has bristles 4 mutually spaced, as predetermined, and arranged to face the photoreceptor drum. A side of transfer roller frame 20 that faces the photoreceptor drum is formed to be open.

With reference to FIG. 2 and 3, recess 25 formed in transfer roller frame 20 receives spring 10 biasing transfer roller 1 toward photoreceptor drum 2 via transfer roller frame 20. Spring 10 is formed of a single elongate member and includes a helical portion 11 formed of the elongate member helically wound to bias transfer roller 1 toward photoreceptor drum 2. Helical portion 11 has one end abutting against a base 6 formed at outer frame 22, and the other end abutting against a bottom surface of recess 25 formed at transfer roller frame 20. Furthermore, spring 10 has a coiled portion 16 wound around a protrusion 7 of outer frame 22.

Figure 5:
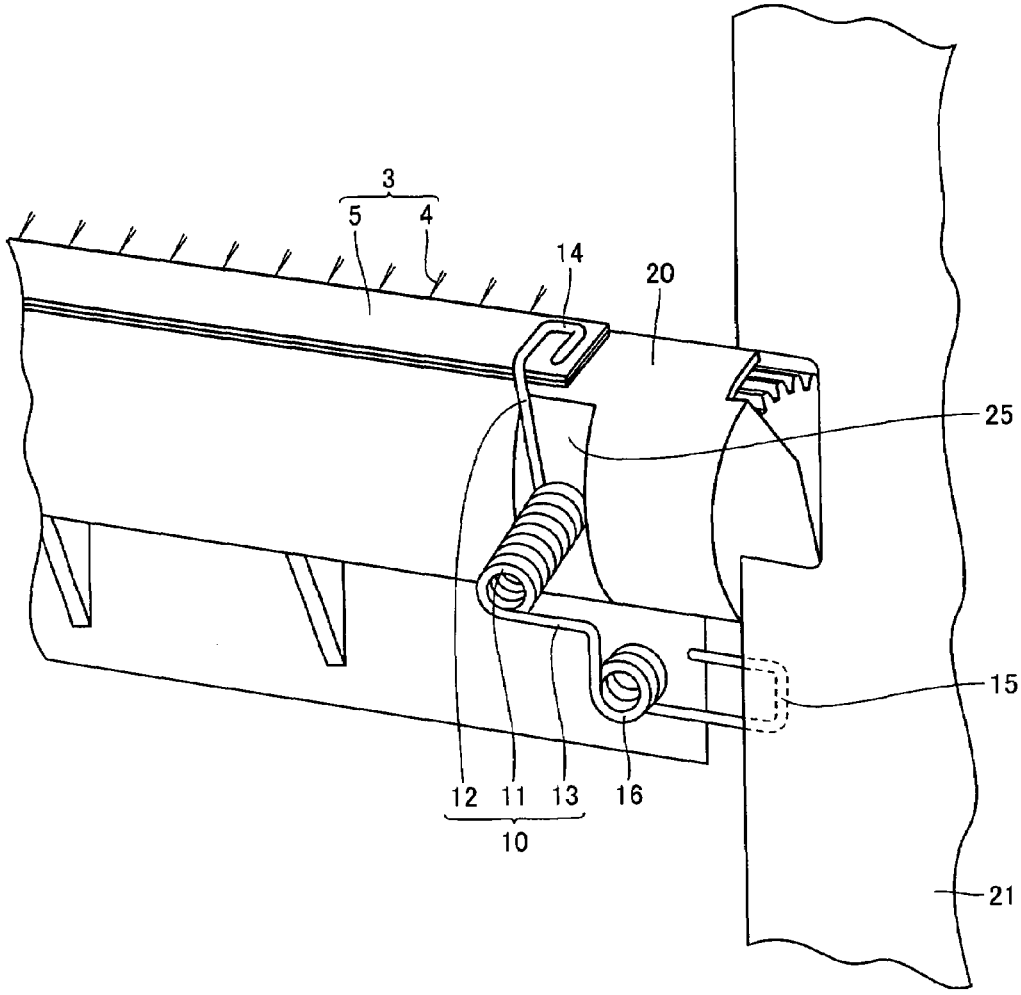
FIG. 5 is an enlarged perspective view of a portion with the transfer roller frame provided with resilient means in the embodiment.

FIG. 5 is an enlarged perspective view of a portion corresponding to spring 10. Spring 10 includes a first extension 12 extending from helical portion 11 toward diselectrification brush 3 to contact the brush. The first extension 12 includes a portion extending from helical portion 11 along a surface of recess 25. The first extension 12 includes a portion extending along an external surface of transfer roller frame 20.

The first extension 12 has an end with a first bent portion 14 in a plane along a surface of diselectrification brush 3 in the form of the letter U, as seen in a plane, contacting diselectrification brush 3 at conductive tape 5 on a surface at a flat portion. The first extension 12 is adapted to be biased toward a surface of diselectrification brush 3. More specifically, the first extension 12 is adapted to have its portion of the elongate member to resiliently press the first bent portion 14 against conductive tape 5.

Spring 10 includes a second extension 13 extending from helical portion 11 toward outer frame 21 to contact the frame. The second extension 13 is formed to extend sideways. The second extension 13 includes a second bent portion 15 contacting outer frame 21 and a coiled portion 16 formed to be biased the second bent portion 15 toward a surface of outer frame 21.

The second extension 13 has an end with a second bent portion 15 in a plane along a surface of outer frame 21 in the form of the letter U, as seen in a plane, contacting outer frame 21 at a flat portion. The second extension 13 includes a coiled portion 16 formed to bias the second bent portion 15 toward outer frame 21.

In FIG. 1 a sheet or the like to be printed is arranged in sheet tray 38. The sheet is transported along transport path 71. The sheet is extracted by pick roller 31 from sheet tray 38, one at a time, and transported by transport roller 32 to photoreceptor drum 2.

Internal to toner cartridge 39, developer roll 34 is rotated to supply photoreceptor drum 2 with toner accommodated in toner cartridge 39. As it is transported through between photoreceptor drum 2 and transfer roller 1, the sheet is provided on a surface thereof with toner in a shape to be printed.

The sheet having passed between transfer roller 1 and photoreceptor drum 2 is diselectrified by diselectrification brush 3 arranged at a location immediately following transfer roller 1 and photoreceptor drum 2. This diselectrification can prevent the sheet or the like to be printed from being attracted to a surface of photoreceptor drum 2. Furthermore the diselectrification can also prevent the sheet being transported from being attracted to other components and thus transported unsmoothly.

The sheet or the like to be printed that has been diselectrified by diselectrification brush 3 is transported toward fixture roller 33. The sheet with toner placed thereon contacts fixture roller 33 and thus has the toner fixed thereon. Thereafter, the sheet is transported for example by a transport roller to an output port. The sheet or the like to be printed is thus printed.

In FIG. 2, high voltage producing plate 28 attains high voltage and supplies it to transfer roller 1 via conical spring 26, connection line 27 and spring 19.

As shown in FIG. 3, photoreceptor drum 2 rotates in direction 62 and in accordance therewith transfer roller 1 rotates. The spring 10 helical portion 11 can bias transfer roller 1 toward photoreceptor drum 2 to cause transfer roller 1 to contact photoreceptor drum 2 via appropriate pressure so as to transport the sheet and place toner thereon simultaneously.

As shown in FIG. 5, in the present embodiment, resilient means is implemented by spring 10, which is formed of a single member and has one end formed to contact diselectrification brush 3 and the other end formed to contact outer frame 21 of metal. This arrangement allows the transfer roller and the diselectrification brush to be biased and grounded, respectively, by a single member. A laser printer having a simplified configuration and a reduced number of components can thus be provided. In the present embodiment diselectrification brush 3 can electrically be connected to outer frame 21 via the first extension 12, helical portion 11 and the second extension 13 and thus grounded.

In the present embodiment the resilient means or spring 10 is formed of a single, metallic elongate member including helical portion 11, the first extension 12 extending toward diselectrification brush 3, and the second extension 13 extending toward outer frame 21. This arrangement can facilitate forming the above described resilient means.

Furthermore in the present embodiment the first extension 12 is linearly formed and adapted to be spring biased toward diselectrification brush 3. This arrangement ensures that the first extension 12 contacts diselectrification brush 3. It also ensures that if the laser printer is used for many years the first extension and the diselectrification brush can still be brought into contact with each other.

Figure 6:
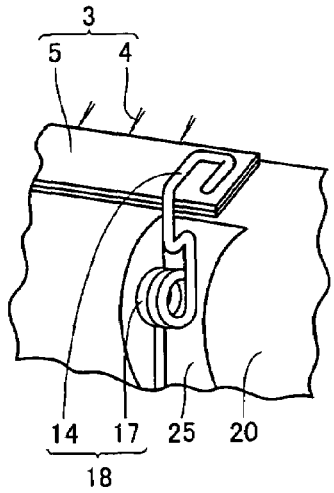
FIG. 6 is an enlarged perspective view of another first extension at the spring in the embodiment.
Figure 7:
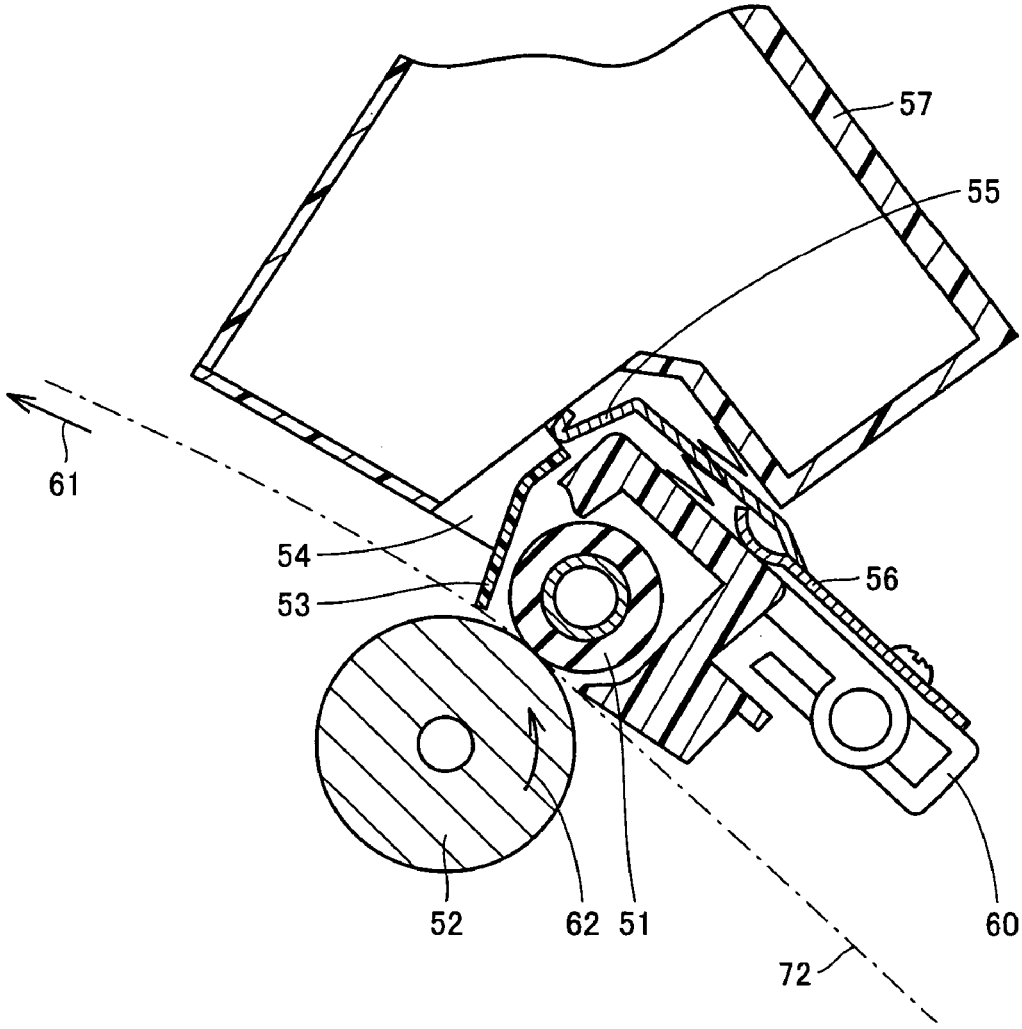
FIG.7 PRIOR ART
FIG. 7 is an enlarged cross section of the portion corresponding to a transfer roller and a photoreceptor drum as based on conventional art.

In the present embodiment the first extension 12 is partially bent to bias the first bent portion 14 toward diselectrification brush 3. However, it is not limited to this manner, and the first extension 12 biased toward diselectrification brush 3 suffices. For example, as shown in FIG. 6, there may be provided a first extension 18 having a coiled portion 17 biasing the first bent portion 14 toward diselectrification brush 3.

Furthermore in the present embodiment spring 10 has the second extension 13 linearly formed and adapted to be biased toward a surface of outer frame 21. More specifically, the second. extension 13 is provided with coiled portion 16 to bias the second bent portion 15 toward the surface of outer frame 21. This arrangement ensures that the second bent portion 15 is brought into contact with outer frame 21. It also ensures that if the laser printer is used over time the second extension 13 can still be brought into contact with outer frame 21.

In the present embodiment the second extension 13 is biased toward outer frame 21 by a means implemented by coiled portion 16. However, it is not limited to this manner, and for example the resilience of metal caused when the metallic second extension is bent may be utilized to bias the second extension 13 toward outer frame 21.

Furthermore in the present embodiment the first extension 12 includes the first bent portion 14 formed to be flat as seen in a plane. The first bent portion 14 is arranged along a flat portion of a surface of diselectrification brush 3 and thus contacts diselectrification brush 3. This arrangement allows the first extension to contact the diselectrification brush over an increased area to reliably ground the brush.

Furthermore the second extension 13 has the second bent portion 15 formed to be flat as seen in a plane. The second extension 13 is arranged along a flat portion of a surface of outer frame 21 and thus contacts outer frame 21. This arrangement allows the second extension 13 to contact outer frame 21 over an increased area to provide reliable grounding.

In the present embodiment the diselectrification brush includes a conductive tape and bristles. However, the diselectrification brush is not limited to this manner, and it may have any configuration that can diselectrify a sheet or the like. Furthermore in the present embodiment the first extension contacts the diselectrification brush at an upper surface. However, it is not limited to this manner, and the first extension that is electrically connected to the diselectrification brush suffices. For example, the diselectrification brush may be provided with a hole receiving the first extension to electrically connect the diselectrification brush and the first extension.

Furthermore in the present embodiment the diselectrification brush is electrically connected to a spring formed of a metallic elongate member. However, it is not limited to this manner, and at least having a surface formed of conductive material suffices. Furthermore a resilient means implemented by a spring including a helical portion is provided. However, it is not limited to this manner, and for example the resilient means may include a plate spring.

Furthermore in the present embodiment the outer frame electrically connected to the resilient means supports a transfer roller frame. However, it is not limited to this manner, and the electrically connected outer frame may be a frame having any conductance. Furthermore the transfer roller frame may be supported for example by a separately formed support frame.

The present invention can provide a laser printer having a simplified configuration and formed of a reduced number of components.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A laser printer comprising:

a columnar photoreceptor drum;

a transfer roller formed in a column and arranged to linearly contact said photoreceptor drum;

a transfer roller frame covering said transfer roller and holding a rotation shaft of said transfer roller;

a metallic outer frame having said transfer roller frame pivotably fixed thereto;

a metallic spring formed to bias said transfer roller frame toward said photoreceptor drum; and a diselectrification brush arranged on an external surface of said transfer roller frame, wherein said spring is formed of a single elongate member, and includes:

a helical portion, a first extension extending from said helical portion toward said diselectrification brush to contact said diselectrification brush, and a second extension extending from said helical portion toward said outer frame to contact said outer frame;

wherein said first extension has a portion bent to be flat, as seen in a plane, along a surface of said diselectrification brush and is formed to be biased toward a surface of said diselectrification brush; and wherein said second extension has a portion bent to be flat, as seen in a plane, along a surface of said outer frame and is formed to be biased toward a surface of said outer frame.

2. The laser printer according to claim 1, wherein the first extension comprises a first coiled portion biasing the first extension toward the surface of the diselectrification brush.

3. The laser printer according to claim 1, wherein the transfer roller frame comprises a recess for receiving the spring.

4. The laser printer according to claim 3, wherein a portion of the first extension extends along a portion of the recess.

5. The laser printer according to claim 1, wherein the second extension comprises a second coiled portion biasing the second extension toward the surface of the outer frame.

6. A laser printer comprising:

an outer frame;

a photoreceptor drum;

a transfer roller contacting said photoreceptor drum;

a transfer roller frame holding said transfer roller;

a diselectrification brush fixed to said transfer roller frame; and resilient means at least having a surface formed of conductive material for biasing said transfer roller toward said photoreceptor drum, wherein said resilient means is formed of a single member, and wherein said resilient means has one end contacting said diselectrification brush and the other end contacting said outer frame.

7. The laser printer according to claim 6, wherein:

said resilient means is formed of a single elongate member of metal, and includes:

a helical portion, a first extension extending toward said diselectrification brush to contact said diselectrification brush, and a second extension extending toward said outer frame to contact said outer frame.

8. The laser printer according to claim 7, wherein said first extension is linearly formed and adapted to be biased toward a surface of said diselectrification brush.

9. The laser printer according to claim 7, wherein said second extension is linearly formed and adapted to be biased toward a surface of said outer frame.

10. The laser printer according to claim 7, wherein the first extension comprises a first coiled portion biasing the first extension toward the diselectrification brush.

11. The laser printer according to claim 6, wherein the transfer roller frame comprises a recess for receiving the resilient means.

12. The laser printer according to claim 11, wherein a portion of the first extension extends along a portion of the recess.

13. The laser printer according to claim 7, wherein the second extension comprises a second coiled portion biasing the second extension toward the outer frame.

* * * * *